US008967841B2

(12) United States Patent
Bohm

(10) Patent No.: US 8,967,841 B2
(45) Date of Patent: Mar. 3, 2015

(54) LED LIGHT MODULE

(75) Inventor: Gerald Bohm, Ybbs (AT)

(73) Assignee: Zizala Lichtsysteme GmbH, Wieselburg (AT)

( * ) Notice: Subject to any disclaimer, the term of this patent is extended or adjusted under 35 U.S.C. 154(b) by 37 days.

(21) Appl. No.: 13/884,152

(22) PCT Filed: Nov. 18, 2011

(86) PCT No.: PCT/AT2011/050033
§ 371 (c)(1),
(2), (4) Date: May 8, 2013

(87) PCT Pub. No.: WO2012/079104
PCT Pub. Date: Jun. 21, 2012

(65) Prior Publication Data

US 2013/0235605 A1 Sep. 12, 2013

(30) Foreign Application Priority Data

Dec. 15, 2010 (AT) ..... A 2068/2010

(51) Int. Cl.
*F21V 7/00* (2006.01)
*F21S 8/10* (2006.01)

(52) U.S. Cl.
CPC ..... *F21S 48/1757* (2013.01); *F21S 48/1388* (2013.01); *F21S 48/1159* (2013.01); *F21S 48/14* (2013.01)
USPC ..... 362/514; 362/507; 362/508; 362/513; 362/543

(58) Field of Classification Search
USPC ..... 362/507, 508, 512, 543, 544, 545, 514
See application file for complete search history.

(56) References Cited

U.S. PATENT DOCUMENTS 6,663,270 B2 * 12/2003 Taniuchi et al. ..... 362/514
6,874,923 B2 * 4/2005 Albou et al. ..... 362/512
8,070,338 B2 * 12/2011 Boroczki et al. ..... 362/512

FOREIGN PATENT DOCUMENTS

JP 2010-000957 1/2010
WO WO2010/079397 * 7/2010

*Primary Examiner* — Ali Alavi
(74) *Attorney, Agent, or Firm* — Sutherland Asbill & Brennan LLP

(57) ABSTRACT

The invention relates to an LED light module (1) for a motor vehicle or for a head light for a motor vehicle, wherein the LED light module (1) has at least one LED light source (3) which comprises at least one light-emitting diode, and wherein the light (10, 11) which is emitted by the at least one LED light source (3) is emitted via at least one reflector (2) into a region located in front of a motor vehicle, wherein the light (10', 11') which is emitted via the reflector (2) forms a defined basic light distribution (30'), wherein according to the invention at least one shutter (4) is provided after the at least one LED light source (3) in the light exit direction, which at least one shutter (4) is located in the beam path of at least part of the light (20) which is emitted in the light exit direction by the at least one LED light source (3), and wherein the at least one shutter (4) is designed to reflect light at least in certain areas on its side (4') facing the at least one LED light source (3), and wherein the at least one shutter (4) is arranged with respect to the at least one reflector (2) and the at least one LED light source (3) in such a way that light (20', 21') which is emitted by the at least one LED light source (3) and is reflected at the least one shutter (4) is reflected onto the at least one reflector (2) and is emitted from there into the external space, wherein the light beams (20'', 21'') which are emitted by the at least one reflector (2) form an additional light distribution (31') which is located at least partially underneath the defined basic light distribution (30') in the light pattern, or in one or more regions of the basic light distribution, preferably in a lower region of the defined basic light distribution (30').

22 Claims, 2 Drawing Sheets

LED LIGHT MODULE

CROSS-REFERENCE TO RELATED APPLICATIONS

This application is the national stage of International Application No. PCT/AT2011/050033,filed Nov. 18, 2010, and claims priority benefit of Austrian Patent Application No. A 2068/2010, filed Dec. 15, 2010. These applictations are incorporated by Reference herein.

The invention relates to an LED light module for a motor vehicle or for a headlight for a motor vehicle, wherein the LED light module has at least one LED light source, which comprises at least one light-emitting diode, and wherein the light emitted by the at least one LED light source is emitted via at least one reflector into a region located in front of a motor vehicle, wherein the light emitted via the reflector forms a defined basic light distribution.

The invention further relates to a vehicle headlight comprising one or more LED light modules of this type.

LED light modules of this type in the form of reflection systems are known from the prior art. In these reflection systems, the light is radiated onto an appropriately designed reflector, for example a free-form reflector and is emitted therefrom into the exterior space, and the configuration of the reflector creates the desired light pattern, for example a low-beam light distribution. A lens for projecting the light pattern onto the road is not provided in such systems.

The LED light source is typically located in the optical axis of the system and in the region of a focal point of the reflector, and the 0° direction of radiation of the LED light source or of the one or more light-emitting diodes that form the LED light source is normal relative to the optical axis. The LED light source, which is to say the 0° direction of radiation, is frequently also inclined toward the reflector.

One characteristic of any dimmed light distribution, for example low-beam light distribution, is that a relatively large amount of light is radiated into a region on the horizontal line, and notably below this horizontal line, as is known to a person skilled in the art, wherein this dimmed light distribution extends downward toward the vehicle over a certain angular range.

The radiation characteristic of light-emitting diodes is shown in FIG. 4 by way of example. A typical characteristic is the approximately hemispherical radiation characteristic with a relatively high amount of radiated light in the 0° direction of radiation and a drastically decreasing amount of radiated light as the angle increases. FIG. 4 shows the relative intensity of the radiation as a function of the angle of radiation. The two maxima are specific to special, frequently employed light-emitting diodes, however what is of more interest for the invention is primarily the symmetrical radiation behavior around the 0° direction of radiation, and in particular the drastic decrease in intensity as a function of the increasing angle of radiation.

Because of this radiation characteristic of light-emitting diodes in cooperation with the above-described arrangement of the light-emitting diodes relative to the reflector, light that is radiated from the light-emitting diode or diodes in the direction of the light exit direction can no longer be used to create the dimmed light distribution by way of the reflector, either because it exits the module directly, without impinging on the reflector, or because it reaches the reflector in a region in which the light can no longer be expediently utilized.

Provided no extraneous light is created by this unused light, this loss of light generally does not pose a problem (although it does lower the efficiency of the optical system because this light remains unused), and since only small amounts of light originate from the regions in question of the angles of radiation of the light-emitting diode(s), this is rather insignificant for creating the dimmed light distribution. If this light should result in extraneous light, measures must be taken so as to prevent this extraneous light from exiting the light module.

It is an object of the invention to improve the efficiency of such an LED module and improve the illumination of the far field of the vehicle.

This object is achieved by an LED module mentioned at the beginning by providing, according to the invention, at least one shutter after the at least one LED light source in the light exit direction, the at least one shutter being located in the beam path of at least a portion of the light emitted by the at least one LED light source in the light exit direction, and wherein the at least one shutter is designed to be reflective in at least some regions in the side thereof facing the at least one LED light source, and wherein the at least one shutter is arranged relative to the at least one reflector and the at least one LED light source such that light that is emitted by the at least one LED light source and reflected by the at least one shutter is reflected onto the at least one reflector and radiated from there into the exterior space, wherein the beams radiated by the at least one reflector form an auxiliary light distribution, which in the light pattern is located at least partially beneath the defined basic light distribution or in one or more regions of the basic light distribution, preferably in a lower region of the defined basic light distribution.

The term "light exit direction" refers to the direction of exit of the bundle of rays out of the LED module, and not to the light exit direction out of the LED light source; the "light exit direction" corresponds approximately to the direction of the optical axis of the LED module.

By using at least one shutter in the beam path after the at least one LED light source, it is possible to radiate light that is emitted by the at least one LED light source, but not used to create the basic light distribution, for example because it would exit the light module directly if no shutter were present or would be radiated by the reflector into a region that is above the bright/dark boundary allowed by law, by reflecting this light at the at least one shutter into a region of the reflector that radiates this light into a region beneath the basic light distribution or into a region of the basic light distribution, preferably into a lower region of the basic light distribution.

A simple way of production and optimal results, especially with regard to light efficacy, are achieved if the entire surface of the at least one shutter is designed to the reflective on the side facing the at least one LED light source.

The light shadowing effect, and light efficacy as well, are optimal if the at least one shutter extends over the entire width of the reflector.

To this end, the at least one shutter can extend transversely relative to the reflector or be designed to be curved toward the reflector. The curvature may be present in the vertical and/or horizontal directions for this purpose. The curvature of the shutter can preferably be adjustable, for example by using a bendable shutter, wherein actuators may be used for curving, for example. In general, the function according to the invention can be implemented by way of multiple shutters, however it is generally advantageous to provide exactly one shutter for manufacturing complexity reasons.

The one or more light-emitting diodes of the at least one LED light source are advantageously located in a horizontal plane, which includes the optical axis of the LED light module.

In addition, the zero degree angle of radiation of the at least one LED light source is inclined at an angle of 90° relative to the optical axis, or is inclined at an angle of less than 90° relative to the optical axis, and counter to the light exit direction.

These arrangements, in which the light-emitting diode(s) radiate(s) upward/downward onto the reflector, take the known radiation characteristic of light-emitting diodes into account.

An inclination relative to the optical axis at an angle of less than 90° toward the back, counter to the light exit direction out of the module, has the advantage that essentially less extraneous light can reach the outside, however in this variant light that otherwise could still be utilized may essentially already be lost.

In addition, advantageously the one or more light-emitting diodes of the at least one LED light source are disposed in a focal point of the reflector or along and/or transversely to, parallel to or in a horizontal plane, which the optical axis, of the optical axis in the region of a focal point of the reflector.

According to one variant, which requires less installation space for the shutter in the light exit direction, the at least one shutter is normal relative to the optical axis.

However, it is also possible for the at least one shutter to be inclined relative to the optical axis at an angle of less than 90°, counter to or in the light exit direction.

A more complex solution is characterized in that the at least one shutter can be moved into the beam path of the at least one LED light source, wherein the at least one shutter can preferably be pivoted about a pivot axis 5, which is preferably parallel to a horizontal plane comprising the optical axis 100.

In this variant, the shutter can be pivoted in, for example when driving at a lower speed, so that a greater far field is achieved in the light pattern, which may be advantageous when driving more slowly on the road, or the like. At higher speeds, the shutter is pivoted out of the beam path, either immediately or with smooth transition, whereby the far field is reduced in the light pattern.

The pivot axis 5 is preferably normal relative to the optical axis 100.

It is additionally advantageous if the pivot axis 5 is located in the horizontal plane comprising the optical axis 100, whereby the shutter can be pivoted basically fully out of the beam path.

In one exemplary variant of the invention, the basic light distribution is a dimmed light distribution, for example a low-beam light distribution. Or it may be a light distribution that is regulated in accordance with ECE R 123, such as highway light, low-beam light, poor weather light, or city light. To this end, for example for highway light, the shutter can be pivoted so that the far field is drastically reduced, which is to say the far field light is pushed under the light/dark boundary, and thus this light is increased, whereby long-range visibility is improved.

In an exemplary variant of the invention, for example when the basic light distribution is a dimmed light distribution such as a low-beam light distribution, the auxiliary light distribution forms a far field light distribution.

So as to attain homogeneous overall light distribution, it is advantageous for the basic light distribution and the auxiliary light distribution to be superposed with each other in the transition region, or to at least directly adjoin each other.

In addition, it may be advantageous if the side of the at least one shutter facing the at least one LED light source comprises at least in some regions, preferably over the entire surface, a structure that increases the homogeneity of the light that is reflected from the side of the at least one shutter, wherein the structure consists, for example, of fluting and/or a bevel and/or an embossment and/or grain on the side of the at least one shutter.

The invention will be described in more detail hereafter based on the drawings. In the drawings.

Figure 1:
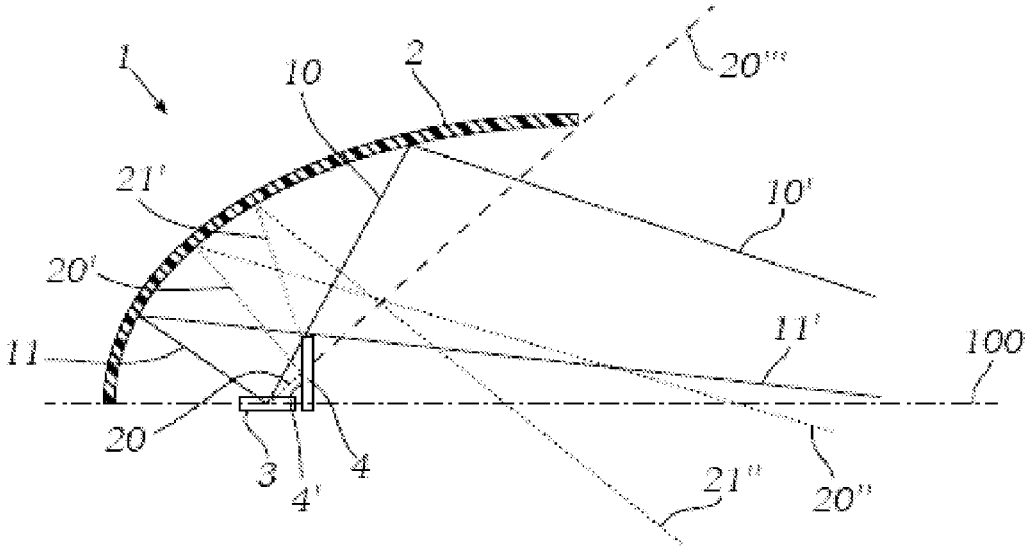
FIG. 1 is a schematic vertical sectional illustration of a light module according to the invention along the optical axis of the module.
Figure 2:
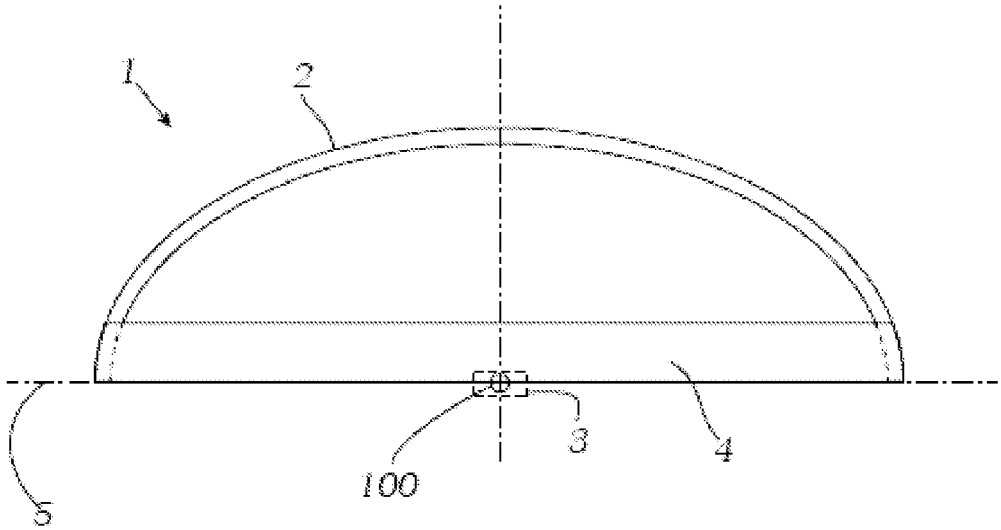
FIG. 2 is a schematic front view of the light module of FIG. 1, with a viewing direction counter to the light exit direction.

FIG. 1 shows a vertical sectional view of an LED light module 1 for a motor vehicle or for a headlight for a motor vehicle, with the light module shown in a front view in FIG. 2. The LED light module 1 has an LED light source 3, which comprises at least one light-emitting diode, and wherein the light 10, 11 emitted by the at least one LED light source is emitted via a reflector into a region located in front of a motor vehicle, wherein the light 10', 11' emitted via the reflector 2 forms a defined basic light distribution 30', which is indicated schematically in FIG. 3.

The schematic illustration shows an ellipsoidal reflector, which reflects the beams 10', 11' forward and downward. However, paraboloid-like reflectors or free-form reflectors are advantageously used with the invention, in which the beams 10', 11' (contrary to what is shown in FIG. 1) exit the light module parallel to the optical axis, which is to say horizontally.

The LED light source 3 is located in the optical axis 100 of the system (light module) and in the region of a focal point or in the focal point of the reflector, and in FIG. 1 the 0° direction of radiation of the LED light source 3 is normal relative to the optical axis 100. The LED light source, which is to say the 0° direction of radiation, is frequently also inclined toward the reflector.

One characteristic of a dimmed light distribution, for example low-beam light distribution, is that a relatively large amount of light is radiated into a region on the horizontal line H-H (FIG. 3), and notably below this horizontal line, as is known to a person skilled in the art, wherein this dimmed light distribution extends downward toward the vehicle over a certain angular range.

Figure 4:
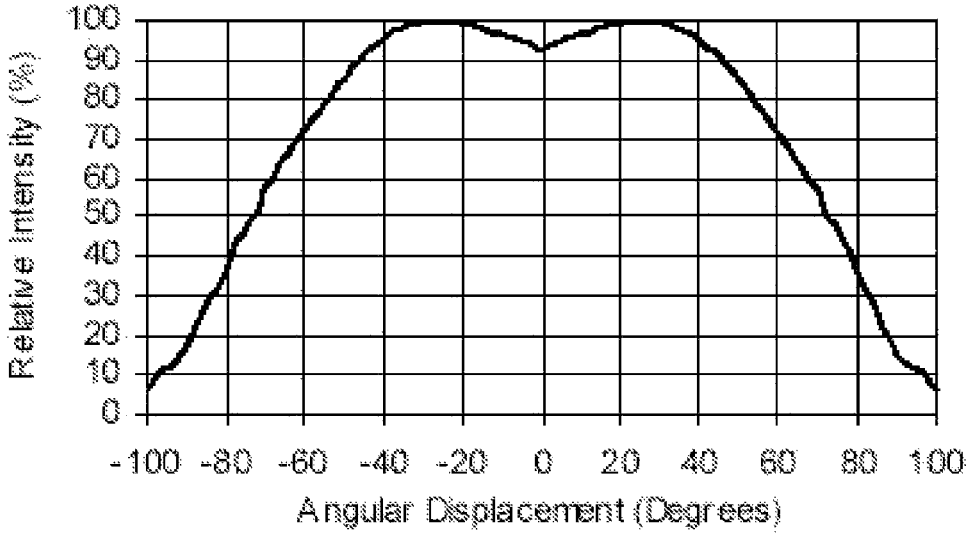
FIG. 4 is a characteristic exemplary radiation characteristic of a light-emitting diode.

The radiation characteristic of light-emitting diodes is shown in FIG. 4 by way of example. A typical characteristic is the approximately hemispherical radiation characteristic with a relatively high amount of radiated light in the 0° direction of radiation and a drastically decreasing amount of radiated light as the angle increases. FIG. 4 shows the relative intensity of the radiation as a function of the angle of radiation. The two maxima are specific to special, frequently employed light-emitting diodes, however what is of more interest for the invention is primarily the symmetrical radiation behavior around the 0° direction of radiation, and in particular the drastic decrease in intensity as a function of the increasing angle of radiation.

Because of this radiation characteristic of light-emitting diodes in cooperation with the above-described arrangement of the light-emitting diodes relative to the reflector, light that is radiated from the light-emitting diode or diodes in the direction of the light exit direction can no longer be used to create the dimmed light distribution by way of the reflector, either because it exits the module directly, without impinging on the reflector, or because it reaches the reflector in a region in which the light can no longer be expediently utilized.

For example, FIG. 1 shows a beam 20 which would exit the light module unused as beam 20''' without the measures according to the invention.

Provided no extraneous light is created by this unused light, this loss of light generally does not pose a problem (although it does lower the efficiency of the optical system because this light remains unused), and since only small amounts of light originate from the regions in question of the angles of radiation of the light-emitting diode(s), this is rather insignificant for creating the dimmed light distribution 30.

So as to also be able to utilize beams such as the schematically shown beam 20, 20''', a shutter 4 is provided in the light exit direction after the LED light source 3, the shutter 4 being located in the beam path of at least a portion of the light 20 that is emitted by the LED light source 3 in the light exit direction.

The shutter 4 is designed to be reflective on the side 4' thereof facing the LED light source 3. In addition, the shutter 4 is disposed relative to the reflector 2 and the LED light source 3 such that light 20', 21' that is emitted by the LED light source 3 and reflected by the shutter 4 is reflected onto the reflector 2 and is radiated from there into the exterior space, wherein the beams 20", 21" radiated by the reflector 2 form an auxiliary light distribution 31', which in the light pattern is located at least partially beneath the defined basic light distribution 30' or in one or more regions of the basic light distribution, preferably in a lower region of the defined basic light distribution.

The reflective property and/or that of the reflector is advantageously achieved by coating the shutter and/or the reflector with a reflective layer, or the shutter and/or the reflector are produced using high gloss materials.

Figure 3:
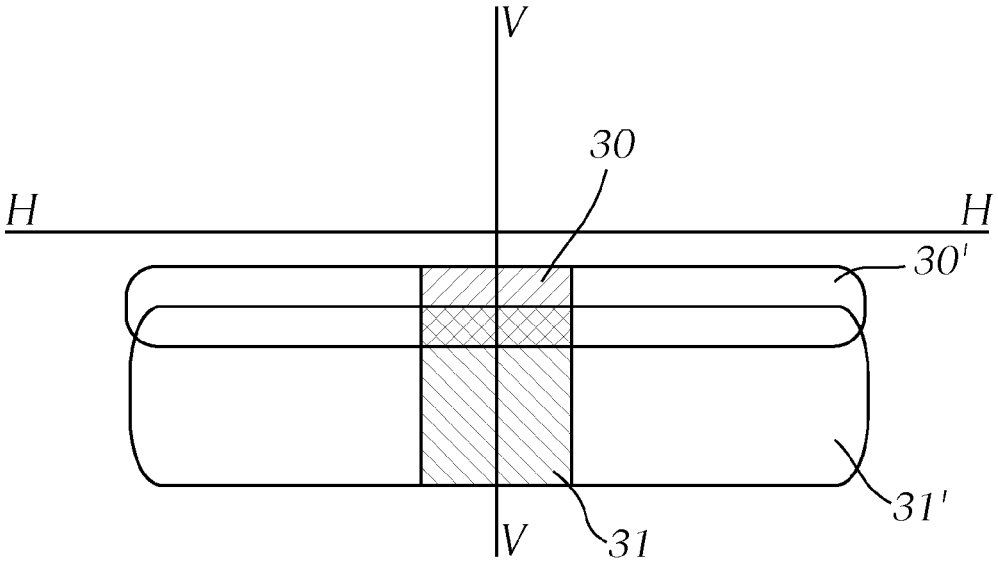
FIG. 3 is an exemplary light distribution created by way of a light module according to the invention.

The auxiliary light distribution thus formed, which adjoins a lower region of the primary light or basic light distribution, is shown in FIG. 3.

The term "light exit direction" refers to the direction of exit of the beam out of the LED module, and not to the light exit direction out of the LED light source; the "light exit direction" corresponds approximately to the direction of the optical axis 100 of the LED module.

By using the shutter 4 in the beam path after the LED light source, it is possible to radiate light that is emitted by the LED light source, but not used to create the basic light distribution, for example because it would exit the light module directly if no shutter were present or would be radiated by the reflector into a region that is above the bright/dark boundary allowed by law, by reflecting this light at the shutter into a region of the reflector that radiates this light into a region beneath the basic light distribution or into a region of the basic light distribution, preferably into a lower region of the basic light distribution.

With respect to the arrangement and height, the shutter is preferably designed so that those boundary beams 10, 11 that still have sufficient luminous intensity to contribute to the basic light distribution 30' can still reach the reflector 2 directly from the LED light source 3. Other beams, such as the beam 20', for example, that already have insufficient intensity, are reflected to the shutter 4 and from there to the reflector 2 and can then be primarily used to illuminate the far field, where lower luminous intensities suffice.

Just how the shutter 4 will be arranged so as to define the boundary beams 10 will also depend on the radiation characteristic of the light-emitting diodes or LED light sources and/or the reflector that are used.

The shutter 4 shown in the figures is designed to be reflective on the entire surface of the side 4' thereof facing the LED light source 3, and the shutter 4 extends (FIG. 2) over the entire width of the reflector 3.

To this end, the shutter 4 can extend in a linear fashion transversely relative to the reflector 3, as shown in FIG. 2, or it may be curved toward the reflector 3 (not shown). The straight shutter 4 shown is disposed normal relative to the optical axis 100.

In one exemplary variant of the invention, as shown, the basic light distribution 30' is a dimmed light distribution, for example a low-beam light distribution (in this example with no asymmetrical component).

In an exemplary variant of the invention, for example when the basic light distribution is a dimmed light distribution such as a low-beam light distribution, the auxiliary light distribution 31' forms a far field light distribution.

FIG. 3 also shows an individual filament image 30 (generated by the light source and a region of the reflector, which is to say imaging of the light source over a particular reflector region) and filament image 31 (generated by the light source, a region of the reflector and the shutter, which is to say imaging of the light source reflected onto a particular reflector region by way of the shutter). Finally, so as to attain homogeneous overall light distribution, as is shown in FIG. 3, it is advantageous for the basic light distribution 30 and the auxiliary light distribution 31' to be superposed in a transition region, or at least to directly adjoin each other.

The invention makes it possible to generate a basic light distribution, for example low-beam light distribution, with low far field illumination. Additional far field illumination can then be generated by way of the shutter.

The invention allows a light distribution that is compliant with the law and has a greater far field to be generated as compared to a conventional system using an LED light source of equal power, or a light distribution that is compliant with the law can be generated with a less powerful LED light source.

A headlight or light module according to the invention is able to satisfy the statutory provisions of various ordinances and legal regulations such as ECE and SAE.

The invention claimed is:

1. A LED light module (1) for a motor vehicle or for a headlight for a motor vehicle, wherein the LED light module (1) has at least one LED light source (3), which comprises at least one light-emitting diode, and wherein the light (10, 11) emitted by the at least one LED light source (3) is emitted via at least one reflector (2) into a region located in front of a motor vehicle, wherein the light (10', 11') emitted via the reflector (2) forms a defined basic light distribution (30'), characterized in that at least one shutter (4) is provided in the exit emission direction after the at least one LED light source (3), the at least one shutter (4) extends over the entire width of the reflector (3) and is located in the beam path of at least a portion of the light (20) that is emitted by the at least one LED light source (3) in the light exit direction, and wherein the at least one shutter (4) is designed to reflect light at least in some regions on the side (4') thereof facing the at least one LED light source (3), and wherein the at least one shutter (4) is disposed relative to the at least one reflector (2) and the at least one LED light source (3) such that light (20', 21') that is emitted by the at least one LED light source (3) and reflected by the shutter (4) is reflected onto the at least one reflector (2) and radiated from there into the exterior space, wherein the beams (20", 21") radiated by the at least one reflector (2) form an auxiliary light distribution (31'), which in the light pattern is located at least partially beneath the defined basic light distribution (30') or in one or more regions of the basic light distribution.

2. The LED light module according to claim 1, characterized in that the at least one shutter (4) is designed to be reflective on the entire surface of the side (4') thereof facing the at least one LED light source (3).

3. A vehical headlight, comprising one or more LED modules according to claim 1.

4. The LED light module according to claim 1, characterized in that the at least one shutter (4) extends in a linear fashion transversely relative to the reflector (3) or is curved toward the reflector (3).

5. The LED light module according to claim 1, characterized in that exactly one shutter (4) is provided.

6. The LED light module according to claim 1, characterized in that the one or more light-emitting diodes of the at least one LED light source (3) are located in a horizontal plane that comprises the optical axis (100) of the LED light module (1).

7. The LED light module according to claim 1, characterized in that the zero degree angle of radiation (0°) of the at least one LED light source (3) is inclined relative to the optical axis (100) at an angle of 90°, or is inclined relative to the optical axis (100) at an angle of less than 90° and counter to the light exit direction.

8. The LED light module according to claim 1, characterized in that the one or more light-emitting diodes of the at least one LED light source (3) are disposed in a focal point of the reflector (2) or along and/or transversely to, parallel to or in a horizontal plane, which includes the optical axis (100), of the optical axis (100) in the region of a focal point of the reflector (2).

9. The LED light module according to claim 1, characterized in that the at least one shutter (4) is normal relative to the optical axis (100).

10. The LED module according to claim 1, characterized in that the at least one shutter is inclined relative to the optical axis (100) at an angle of less than 90°, counter to or in the light exit direction.

11. The LED module according to claim 1, characterized in that the at least one shutter can be moved into the beam path of the at least one LED light source.

12. The LED module according to claim 11, characterized in that the pivot axis is normal relative to the optical axis.

13. The LED module according to claim 11, characterized in that the pivot axis is located in the horizontal plane that comprises the optical axis.

14. The LED module according to claim 1, characterized in that the basic light distribution (30') is a low beam or other dimmed light distribution.

15. The LED module according to claim 1, characterized in that the auxiliary light distribution (31') is a far field light distribution.

16. The LED module according to claim 1, characterized in that the basic light distribution (30') and the auxiliary light distribution (31') are superposed in a transition region or at least directly adjoin each other.

17. The LED module according to claim 1, characterized in that the side (4') of the at least one shutter (4) facing the at least one LED light source (3) comprises, at least in some regions a structure that increases the homogeneity of the light that is reflected from the side (4') of the at least one shutter.

18. The LED light module according to claim 17, wherein the structure that increases the homogeneity of the light reflected from the side(4')of the at least one shutter is provided over the entire surface of the side (4')of the at least one shutter (4)facing the at least one LED light source (3).

19. The LED light module according to claim 17, wherein the structure consist of fluting, a bevel, an embossment , grain, or a combination thereof.

20. The LED light module according to claim 1, wherein the at least one shutter can be pivoted about a pivot axis.

21. The LED light module according to claim 20, wherein the pivot axis is parallel to a horizontal plane which comprises the optical axis.

22. The LED light module according to claim 1, wherein the light pattern is located in a lower region of the defined basic light distribution(30').

* * * * *